United States Patent [19]

Rylewski

[11] 4,008,013

[45] Feb. 15, 1977

[54] FLUID ROTATIVE MACHINE WITH VARIABLE DISPLACEMENT

[76] Inventor: Eugeniusz M. Rylewski, 43 bis, Avenue du Gal Leclerc, 78470 St. Remy les Chevreuse, France

[22] Filed: Jan. 5, 1976

[21] Appl. No.: 646,677

[30] Foreign Application Priority Data

Jan. 3, 1975 France ..... 75.00153

[52] U.S. Cl. ..... 418/16; 418/111; 418/226

[51] Int. Cl.[2] ..... F04C 29/10; F04C 27/00; F04C 17/00

[58] Field of Search ..... 418/16, 19, 20, 29, 418/30, 31, 195, 196, 226, 55, 57, 111

[56] References Cited

UNITED STATES PATENTS

| | | | |
|---|---|---|---|
| 1,037,655 | 9/1912 | Peigler | 418/226 X |
| 1,304,497 | 5/1919 | Maxam | 418/226 |
| 2,948,228 | 8/1960 | Ahlen | 418/19 |
| 3,904,331 | 9/1975 | Rylewski | 418/215 X |

FOREIGN PATENTS OR APPLICATIONS

| | | | |
|---|---|---|---|
| 1,268,586 | 6/1961 | France | 418/195 |

*Primary Examiner*—C. J. Husar
*Assistant Examiner*—Leonard Smith
*Attorney, Agent, or Firm*—Morgan, Finnegan, Pine, Foley & Lee

[57] ABSTRACT

A rotative machine for fluids comprising a plate with spiral-like passages for the circulation of fluid therein, in which also circulate the vanes of vane wheels carried by a disc coaxial to and facing said plate.

Spiral-like walls placed inside the passages are movable in relation to the passages so as to vary the cross-sections of the passages and, consequently, the fluid circulating therein.

8 Claims, 12 Drawing Figures

Fig.9
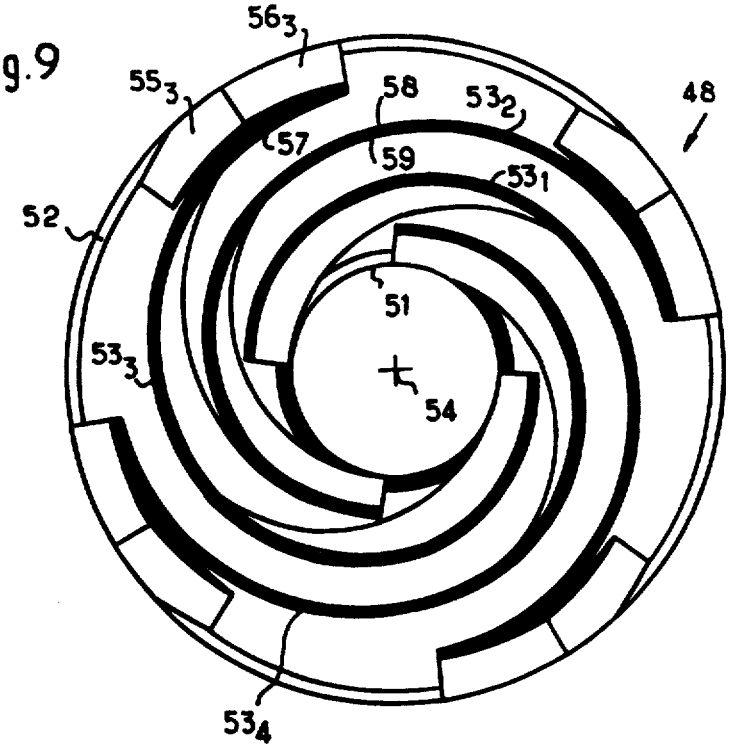
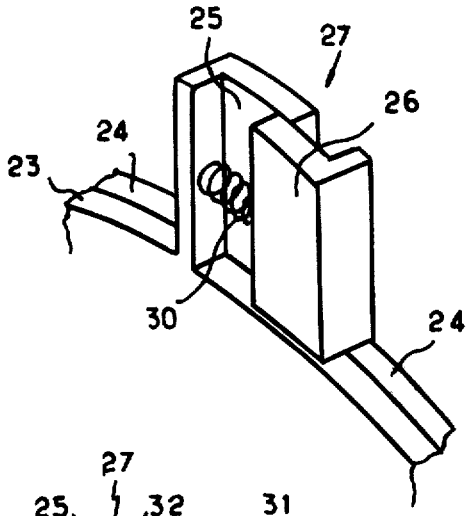
Fig.3
Fig.4
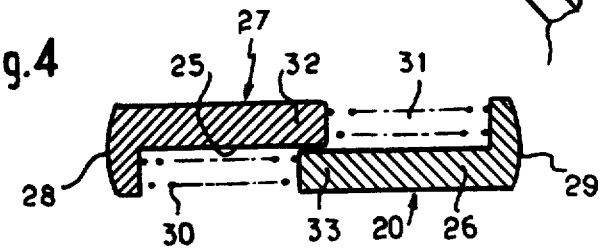

FLUID ROTATIVE MACHINE WITH VARIABLE DISPLACEMENT

The object of this invention is to provide a fluid rotative machine with variable displacement.

The rotative machine of this invention comprises a plate with spiral-like passages or grooves with which cooperate the vanes of vane wheels carried by a disc facing the aforesaid plate. The vane wheels are distributed angularly about an axis common to the axes of rotation of both the plate and the disc and are mounted for rotation around axes transverse to the said common axis. Each vane is bordered, in the aforesaid passages by a movable compartment for the fluid formed, moreover, by the slidingly cooperating surfaces of the plate and the disc.

The side walls of the passages of the plate are described by the lateral edges of the vanes during the composed movement of the latter resulting, on the one hand, from the relative rotation of the plate with respect to the disc and, on the other hand, from the rotation of the vane wheels about their own axes. In addition, the bottom surface of the passages is described by the frontal side of a vane during its composed movement. The configuration of the conjugated surfaces of the plate and the disc sliding one on the other defines the depth of the compartments for fluid and is chosen according to the law which one desires to obtain for the variation of the volume of the said compartment along a passage, including the non-variation of the volume in the case of a machine for liquids.

Prior machines of this type are described in the French patents listed below filed in the name of the present applicant:

French Pat. No. 71.20194 filed on the 3rd of June 1971 for "Driving or driven machines for liquids", French Pat. No. 71.20195 filed on the 3rd of June 1971 for "Driving or driven machines for gases", French Pat. No. 71.20196 filed on the 3rd of June 1971 for "Gas turbine".

The machines of this type proposed so far have a fixed displacement, that is to say, the total volume offered by a given machine to the fluid circulating therein is a constant of the machine and cannot be modified during the operation of the machine.

The object of the present invention is a machine of the type described above but which, on the contrary, has a variable displacement.

According to the present invention, there is provided a rotative machine having a plate with spiral-like passages of the type described above, which comprises means to vary the transverse section of the spiral-like passages in the aforesaid plate.

According to an embodiment of the present invention, an adjustable device of spiral-like walls is added to the plate with spiral-like passages, which, in one position, has its spiral-like walls joined side by side with first side walls of the passages and which is movable so that the spiral walls can be brought closer to the opposite side walls of the passages, thus defining with the said opposite side walls of the circulation conduits of variable transverse sections depending on the position of the device.

According to the embodiment of the present invention, the adjustable device comprises a central ring and a peripheral ring, which are in fixed relationship one with the other, the rings being mounted for rotation coaxially to the plate with the passages, the extremities of the spiral-like walls being connected to the said rings.

The relative rotation of the rings with the spiral-like walls to the plate can be operated manually or automatically, advantageously by the pressure of the fluid.

The machine of the invention also includes vane wheels of variable width, made in several parts mounted for relative movement under the action of elastic means, so that the lateral edges of the vanes cooperate with the passage side walls, defining with them compartments for the circulation of the fluid having different, adjustable positions depending upon the position of the aforesaid device with rings and spiral-like walls, thus providing the sealing of the compartments for the fluid.

In the following description, made as an example, reference is made to the accompanying drawings, in which:

FIG. 3 is a schematic view in perspective of a portion of the device for vane wheels;

FIG. 4 is a view in transverse section of the vane shown in FIG. 3;

FIG. 9 is a front view of a device with spiral-like walls;

Figure 1:
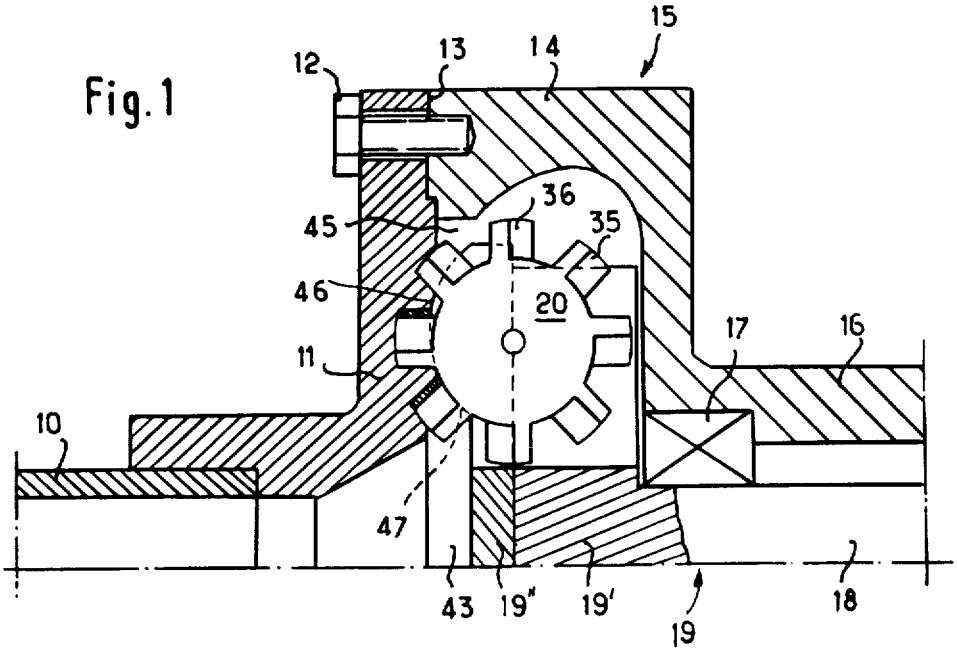
FIG. 1 is a view in axial semi-section.

Referring now to the drawings, the rotative machine comprises a central pipe 10 (FIG. 1) for the inlet of the fluid to which a plate 11 is fixedly mounted and, in turn, is secured by bolts 12 to the side 13 of the body 14 of a case 15 extending into a cylindrical bearing casing 16.

Inside the bearing casing 16 is mounted, for rotation, through a bearing 17 a shaft 18 which ends in machine part 19 housing vane wheels, the said machine part thus being located between the plate 11 and the case 15.

As used herein, the plate 11 will sometimes be called a stator and the machine part 19 will sometimes be called a rotor, but the invention applies also to machines in which the plate 11 rotates and the machine part 19 is stationary and also to machines in which the plate 11 and the machine part 19 both have different rotating movements.

Figure 2:
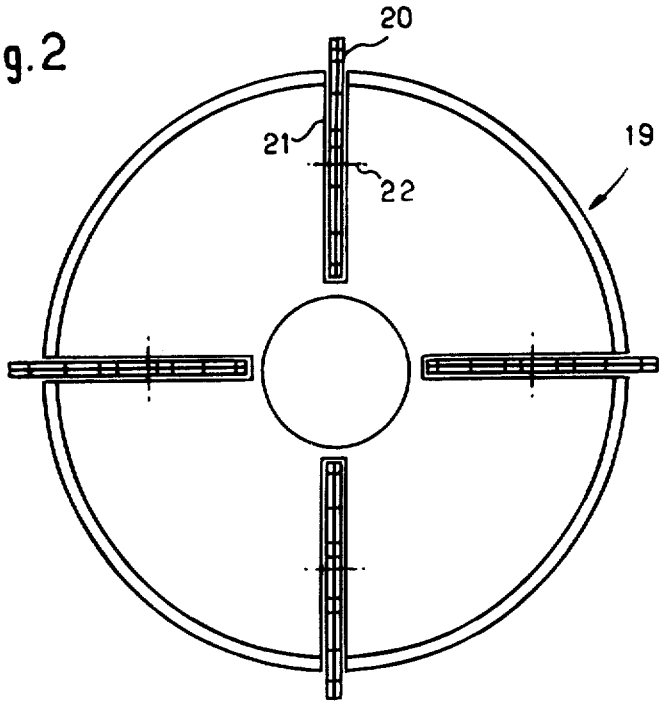
FIG. 2 is a front view of a disc with vane wheels.

The vane wheels 20 (FIG. 2) are housed in longitudinal slots 21 made in the body 19' of the rotor and in the disc 19'' fixedly mounted to body 19' by its internal face, and are disposed angularly at equal distances around the axis of the rotor. The vane wheels 20 are mounted for rotation relatively to the machine part carrying them, around their own axes 22, perpendicular to the axis of the shaft 18 and housed at the junction of the body 19' with the disc 19''.

Each vane wheel 20 comprises two wheels 23 and 24 (FIG. 3) joined side by side. The wheel 23 includes a portion 25 of each vane and the wheel 24 includes a portion 26 of each vane, the two portions 25 and 26 of the vanes mounted side by side constituting a vane 27, the longitudinal sides 28 and 29 of which are at variable distance because of the action of spring means 30 and 31, which act on portions 25 and 26 of the vanes, respectively, to keep them apart one from the other. Superimposed zones 32 and 33 of the portions 25 and 26 of the vanes have smaller thicknesses than the sides 28 and 29.

In an alternate embodiment of the invention, each vane may comprise movable portions greater than two in number.

In another embodiment of the present invention (FIGS. 5 and 6), each vane wheel comprises two vane wheels 101 and 102 with vanes 25, 26 similar to those represented in FIGS. 3 and 4. The bodies 103 and 104 of the vane wheels 101, 102 are mounted side by side with a possibility of relative rotation therebetween. Spring means 105 is secured to one of the extremities 106 of the body 103 and to another extremity 107 of the body 104, which tend to rotate both vane wheels, one in relation to the other, in the direction which gives to each vane is maximum width. The spring means 105 is housed in the angular cavities 108 and 109 made in bodies 103 and 104 and facing each other.

Figure 8:
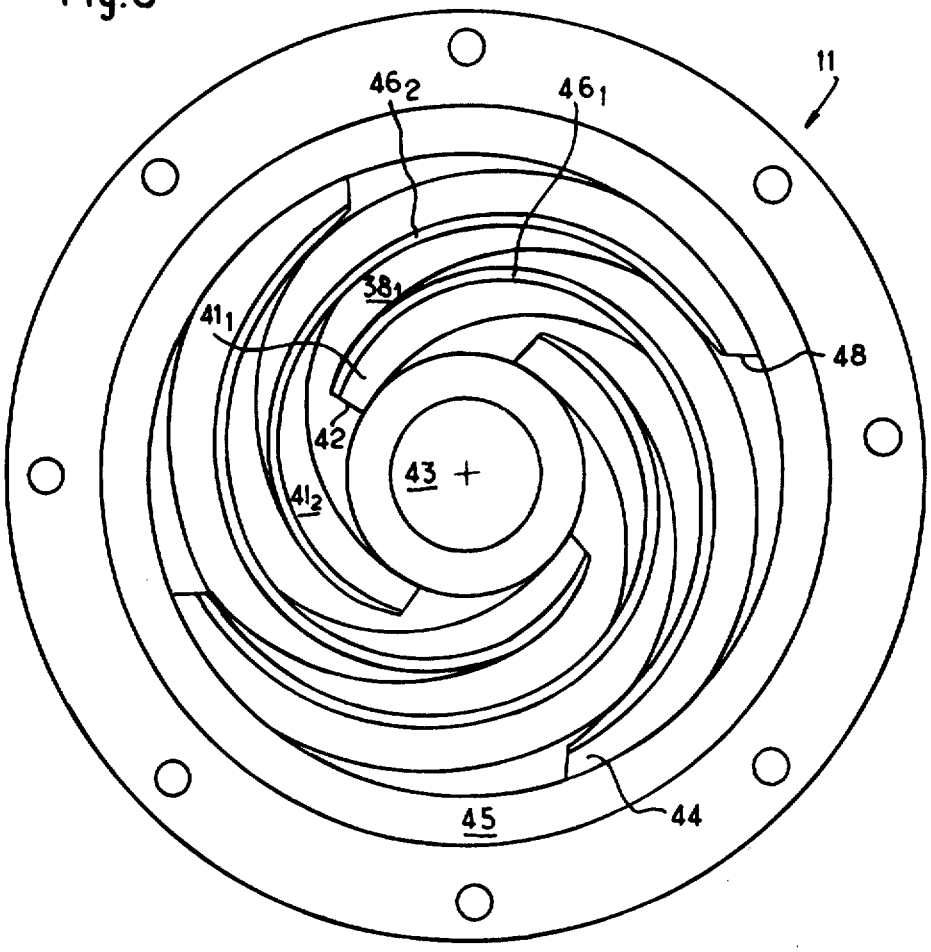
FIG. 8 is a front view of a plate with the spiral-like passages.

The vanes 27, of variable width, cooperate slidingly by their frontal sides 36 (FIG. 7) with the bottom 37 of the spiral-like passages 38 formed in the plate 11 and facing the disc 19''. A spiral-like passage is defined, in addition to its bottom 37, by an inner side wall 40 formed by rib 41 in the form of a spiral, protruding from the body of the plate 11 (FIG. 8), one extremity 42 (FIG. 8) of which is adjacent to a central orifice 43 of the plate 11 and the other extremity 44 of which is adjacent to the annular space 45 made in the body 14. A spiral-like passage $38_1$ is thus bordered by a first spiral-like rib $41_1$ and by a second spiral-like rib $41_2$ angularly offset by 90° in relation to the first one, in the present example. The ridges $46_1$ and $46_2$ of the said passages are curved so as to cooperate sealingly with a conjugated surface of revolution 47 formed on the disc 19''.

The machine of the present invention includes a device 48 with spiral-like walls, constituted by a central ring 51 (FIG. 9) and a peripheral ring 52 between which are mounted spiral-like walls 53, four in number in the illustrative example, designated $53_1$, $53_2$, $53_3$, and $53_4$, of a configuration conjugated with the configuration of the passages 41. The walls are angularly offset in relation to one another by 90° around the axis 54 common to rings 51 and 52. In addition to this, partially cylindrical units 55, 56, from which depend the external extremities 57 of the spiral-like walls 53, are fixedly mounted with the peripheral ring 52.

Thus, the spiral-like walls 53 are, for a given angular position of the device 48, united by their external faces 58 with the outer side walls 49 of the passages 38. For such a condition, which is shown in FIG. 10, the transverse sections of the passages for the circulation of the fluid are at a maximum and, consequently, when the rotor 19, having the vane wheels 20, rotates, the displacement of the rotative machine is at a maximum.

During the relative rotation of the plate 11 and the machine part 19 having the vane wheels, a transfer of fluid takes place between the central orifice 43 and the annular space 45, which is caused by the movement of the vanes 27 of the wheels 20, in the circulation conduits which receive the said vanes. The said circulation conduits are bordered, in addition to the inner side walls 40 of the passage 38, by the bottom 37 and the convex surface 47, and by the internal face 59 of the spiral-like wall 53 housed in the said passage. The said wall 53 is then united by its external face 58 with the outer side wall 49 of the passage. The longitudinal sides 28 and 29 of a vane circulating in the conduit are applied, by the action of the springs 30 and 31, or 105, on the one hand, against the inner side wall 40 of the passage, and, on the other hand, against the internal face 59 of the spiral-like wall 53. Such a position is shown in schematic by reference numeral 1 in FIG. 7. The machine operates, in that case, in a condition of maximum displacement.

Figure 6:
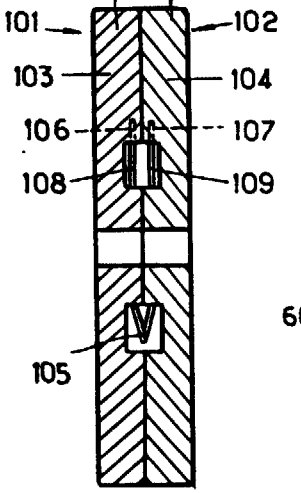
FIG. 6 is a view in axial section corresponding to FIG. 5.
Figure 5:
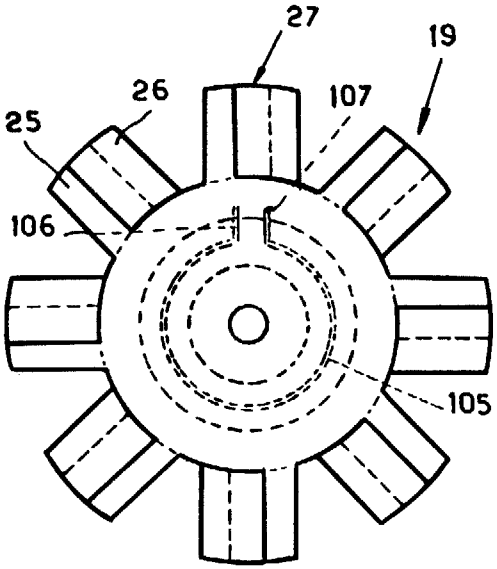
FIG. 5 is a front view of a device for vane wheels, constituting another embodiment of the invention.
Figure 7:
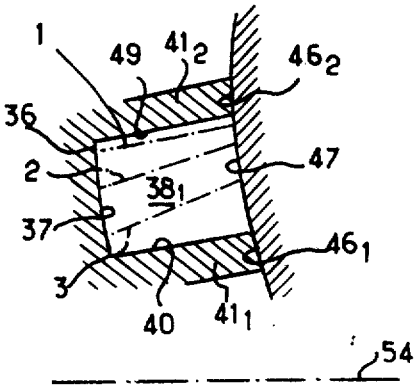
FIG. 7 is a schematic view in transverse section of a spiral-like passage on a plate.
Figure 10:
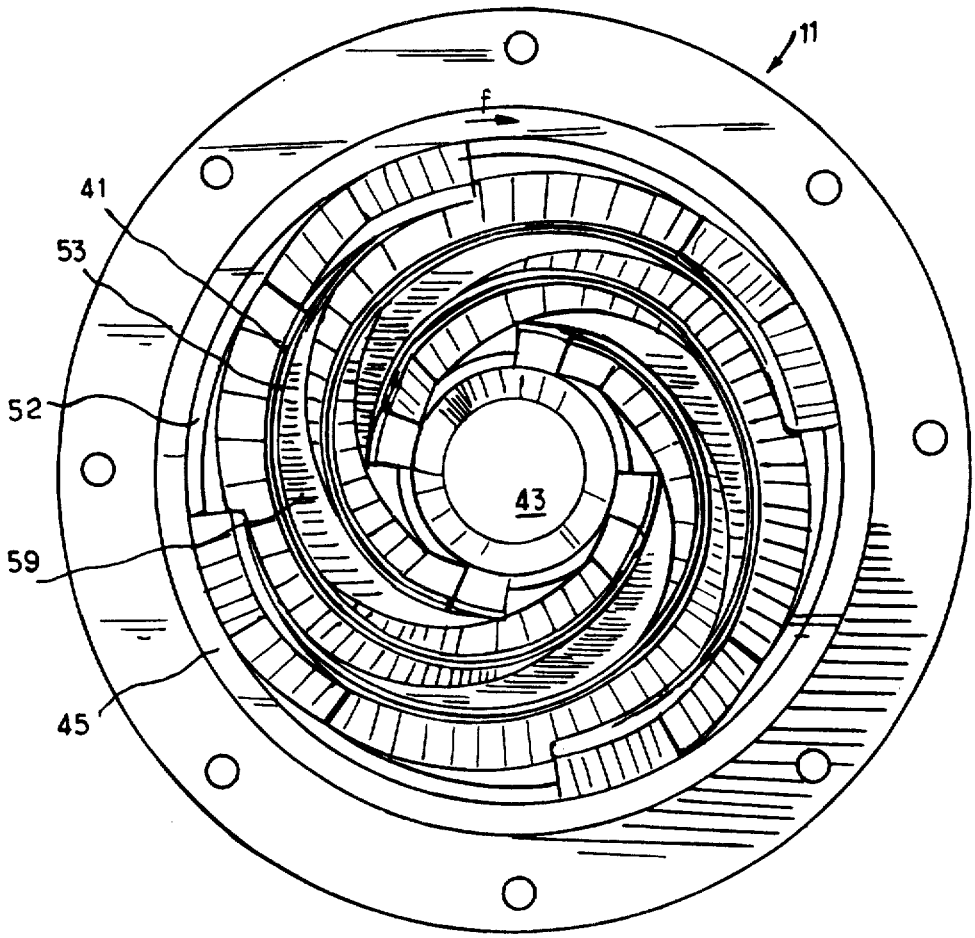
FIG. 10 is a view similar to FIG. 8, illustrating the plate equipped with the said device with walls.

By relative rotation of the device 48 with walls and rings in respect to the plate 11 of the stator in the direction of the arrow *f* in FIG. 10, the spiral-like walls 53 move away from the external flanks 49 of the passages 38 to take, for example, a position shown in schematic by reference numeral 2 in FIG. 7. The cross-section of the conduits for the circulation of fluid is still limited by the inner side wall 40 of the passage and by the internal face 59 of the spiral-like wall 53, but as the latter is moved closer to the inner side wall 40, the aforesaid cross-section becomes smaller. The vanes 27 have a width which is smaller than in the condition of departure, the wheel 103 having slightly turned in respect to the wheel 104 under the action of the spring 105 in the structure of the wheels as shown in FIGS. 5 and 6. In this condition, the rotative machine of the present invention has, therefore, a displacement which is smaller than in the condition analyzed above. The law of variation of the transverse section of the passage for the fluid along the length of the passage is the same as this which would correspond to a passage not equipped with a spiral-like wall.

Figure 11:
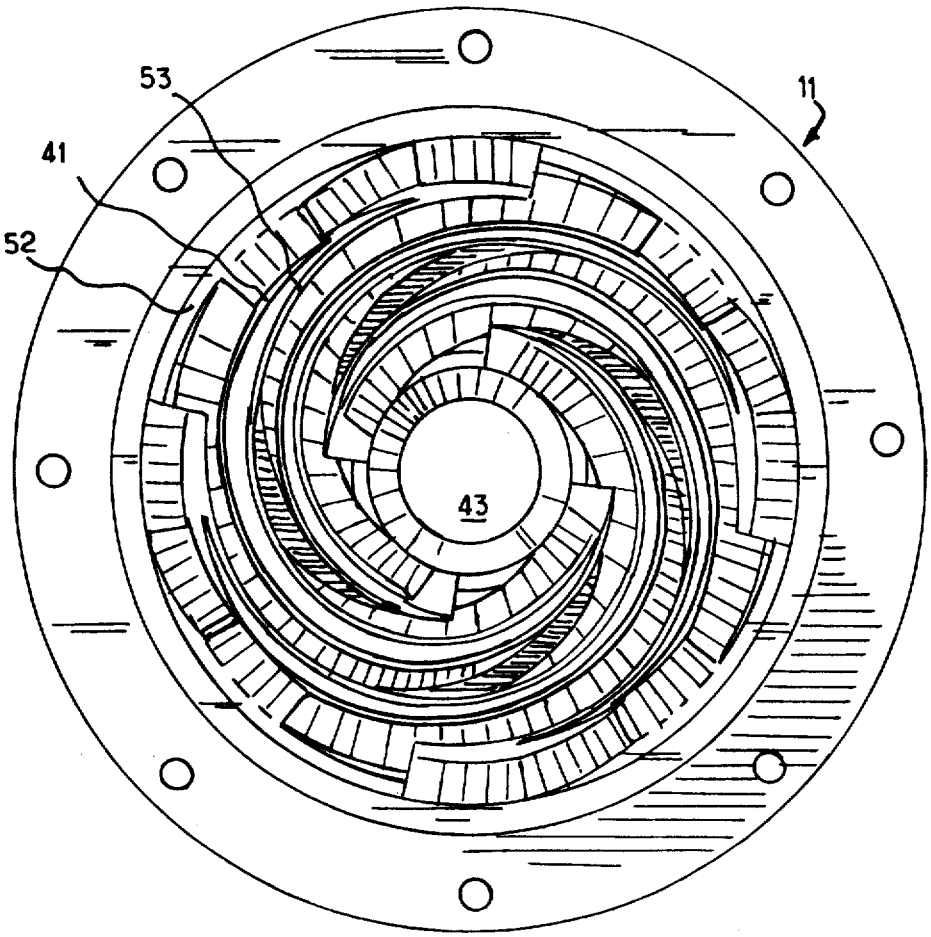
FIG. 11 is a view similar to FIG. 10 but for another condition.

The position represented by reference numeral 3 for the spiral-like wall 53 (FIG. 7) represents schematically the position for which the displacement of the machine is minimum. Such a condition of the machine is represented in FIG. 11.

The units 55 and 56 prevent a direct communication between the inlet and the outlet of the fluid circulating in the machine. The internal faces of the units 55 and 56 have a shape conjugated with the external face of the ribs 41. Moreover, the units 55 and 56 can be made in one piece.

The walls 55, at their extremity being the closest to the center, have their external face cooperating with the internal face of the extremity 41 of the passage.

The variation of the displacement can be obtained by a manual operation of the device 48 with the walls.

The present invention provides also for an embodiment in which the variation of the displacement is obtained by an introduction of the power fluid to the space between the outer side wall of the passage and the wall housed in the said passage. This introduction is controlled in relation to the operative conditions of the machine.

Such a disposition of movable spiral-like walls can be utilized in rotative machines designed as hydraulic pump, motor, compressor, turbine or gas engines. It permits all of such machines to be built with variable displacement.

Figure 12:
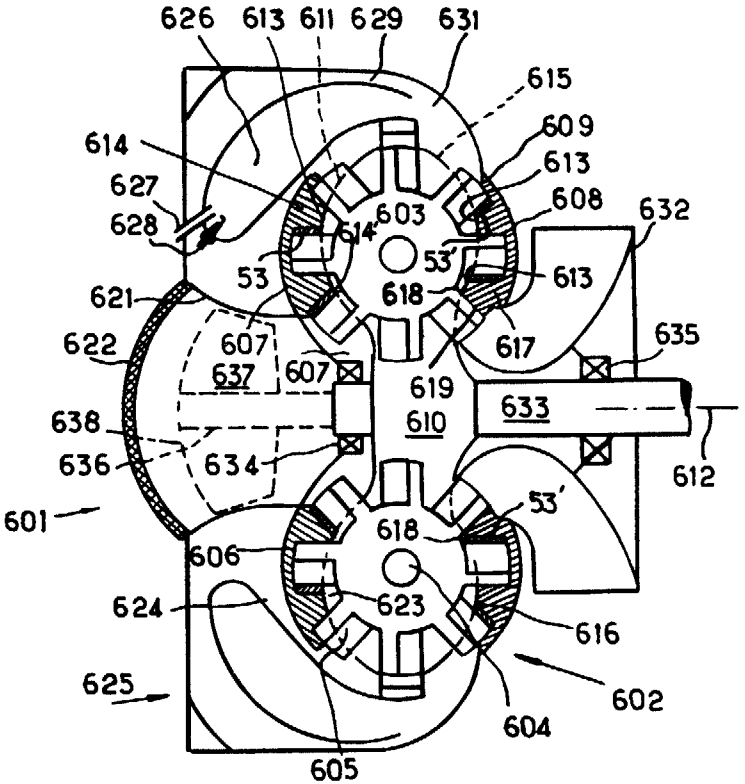
FIG. 12 is a schematic view of a gas turbine embodying the present invention.

In a gas turbine, represented schematically in FIG. 12, wheels 603, mounted for rotation around axes 604, have vanes 605 which circulate, on the one hand, in the spiral-like circulation conduits 606 of the stator 607 of the compressor 601. The compressor has variable displacement on account of the fact that in the spiral-like passages of the stator 607 there are housed the spiral-like walls 53 belonging to a first device for the control of the displacement and that the vane wheels 603 have vanes of variable width so as to adjust to the width of the circulation conduits.

The vanes 605 also circulate in spiral-like circulation conduits 608 of the stator 609 of the engine proper 602. The said circulation conduits have a transverse section which varies when a second device 53 with spiral-like walls is displaced, but which, for the condition of maximum displacement of the engine, has its walls in contact with the inner side walls of the passages and not with the outer side walls as is the case with the compressor 601.

The body 610 of the rotor has, on one side, a first incurved face 611, of revolution around the axis 612 of rotation of the rotor, which cooperates with top faces 613 of the ribs 614 bordering the adjacent passages of the stator 607 and with the ridges 614' of the spiral-like walls 53.

The body 610 of the rotor has, on the other side, facing the stator 609 of the engine, a second incurved face 615, of revolution around the axis 612, which cooperates with the top faces 613 of the ribs 617 bordering the passages 608 of the stator 609 and with the ridges 618 of the spiral-like walls 53' of the second device, so as to ensure sealing of the circulation conduits.

The air entering the compressor by a central inlet 621, protected by a screen 622, reaches the central opening of the stator 607 of the compressor, is compressed by the circulation of the vanes 605 of the wheels 603 in the spiral-like passages of the stator 607, and is discharged, under pressure, through the peripheral pipe 624 to a combustion chamber 625. The said combustion chamber has an internal compartment 626 to which the fuel is admitted through a feeding device 627. The mixture of air under pressure with the fuel, possibly ignited by an ignition device 628 or by the elevation of temperature due to the increase in pressure, creates high temperature combustible gases. The latter are mixed with a portion of the compressed air which circulates along a peripheral circuit 629 of the chamber. The whole reaches, through the intake piping 631, the periphery of stator 609 of the engine 602, where the internal energy of the hot gases is utilized to drive, by direct action on the vanes 605 of the wheels inside the passages 608 of the stator 609, the rotor 610 housing the said wheels. The gases leave the passages 608 at the central part of the stator 609 and are evacuated by an outlet piping 632. The work is collected on the shaft 633 of the rotor 610 which is supported by bearings 634 and 635.

The angular displacement of the first control device with spiral-like walls allows the variation of the displacement of the compressor. The angular displacement of the second control device with spiral-like walls allows the variation of the displacement of the engine per se.

Thus, the present invention also provides a simultaneous variation, and of the same quantity, of the displacement of the compressor and of the displacement of the engine proper.

What is claimed is:

1. In a rotative gas engine including a gas compressor and a gas turbine, each being of the type having the spiral-like passages and vane wheels, wherein the same part carrying the vane wheels cooperates with the passages of the compressor and with the passages of the turbine, the improvement therein which comprises:

each of said compressor and said turbine including spiral-like wall means placed inside said passages and movable in relation thereto so as to vary the cross-sections of the passages and, consequently, the fluid circulating therein.

2. In a rotative machine for fluids, including a plate with spiral-like passages for the circulation of fluid therethrough, in which also circulate the vanes of vane wheels carried by a disc coaxial with and facing said plate, the improvement therein which comprises:

spiral-like wall means placed inside said passages and movable in relation thereto so as to vary the cross-sections of the passages and, consequently, the fluid circulating therein.

3. A machine as claimed in claim 2, wherein the vanes cooperating with the passage for the circulation of fluid include means maintaining their side edges constantly in contact with the side walls of the passages.

4. A machine as claimed in claim 2, wherein the relative displacement of the spiral-like walls with respect to the side walls of the passages is controlled by the pressure of the fluid circulating therein.

5. A machine as claimed in claim 2, wherein said machine is utilized as a hydraulic motor or pump.

6. A machine as claimed in claim 2, wherein said machine is utilized as a gas motor or pump.

7. A rotative machine as claimed in claim 2, wherein the spiral-like walls corresponding to the passages of the plate are formed on a device mounted concentrically to the plate and to the disc, the relative rotation of which causes the variation of the width of the cross-sections of the passages and, consequently, the circulation conduits.

8. A machine as claimed in claim 7, wherein the spiral-like walls are supported by a central ring and by a peripheral ring.

* * * * *